US007587152B2

(12) United States Patent
Itoh et al.

(10) Patent No.: US 7,587,152 B2
(45) Date of Patent: Sep. 8, 2009

(54) POWDER TRANSPORT DEVICE AND IMAGE FORMING SYSTEM

(75) Inventors: Fumihito Itoh, Kanagawa (JP); Hirosato Amano, Shizuoka (JP); Kazuhisa Sudo, Kanagawa (JP); Hiroshi Sano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 377 days.

(21) Appl. No.: 11/683,656

(22) Filed: Mar. 8, 2007

(65) Prior Publication Data

US 2007/0212117 A1 Sep. 13, 2007

(30) Foreign Application Priority Data

Mar. 10, 2006 (JP) ..... 2006-065750
Apr. 28, 2006 (JP) ..... 2006-124698

(51) Int. Cl.
*G03G 15/00* (2006.01)

(52) U.S. Cl. ..... 399/88; 399/90

(58) Field of Classification Search ..... 399/88, 399/89, 90
See application file for complete search history.

(56) References Cited

U.S. PATENT DOCUMENTS 5,727,607 A 3/1998 Ichikawa et al.
5,909,609 A 6/1999 Yahata et al.
5,950,055 A 9/1999 Yahata et al.
5,950,062 A 9/1999 Yahata et al.
5,960,246 A 9/1999 Kasahara et al.
6,014,533 A * 1/2000 Kawana ..... 399/90
6,091,912 A 7/2000 Kitajima et al.
6,393,241 B1 5/2002 Matsumoto et al.
6,501,913 B2 12/2002 Hattori et al.
6,577,842 B2 6/2003 Akiba et al.
6,591,077 B2 7/2003 Yanagisawa et al.
6,628,908 B2 9/2003 Matsumoto et al.
6,648,029 B1 11/2003 Amano
6,665,508 B2 12/2003 Sudo et al.

(Continued)

FOREIGN PATENT DOCUMENTS

JP 11-212348 8/1999

(Continued)

OTHER PUBLICATIONS

U.S. Appl. No. 12/018,611, filed Jan. 23, 2008, Sano.

(Continued)

*Primary Examiner*—Hoang Ngo
(74) *Attorney, Agent, or Firm*—Oblon, Spivak, McClelland, Maier & Neustadt, P.C.

(57) ABSTRACT

A powder transport device includes a powder storing unit having a powder storing part which stores powder, and a container unit having a container part in which the powder storing unit is accommodated. The powder storing unit comprises a motor part for operating the powder storing unit, an electrical wiring for transmitting an electric signal sent from the motor part or a driving current sent to the motor part, and a first connector for providing electrical conduction between the electrical wiring and an external wiring. The container unit comprises a second connector electrically connected to the external wiring, the second connector being engaged with the first connector so that the first connector provides electrical conduction between the electrical wiring and the external wiring.

20 Claims, 10 Drawing Sheets

U.S. PATENT DOCUMENTS

| | | | | |
|---|---|---|---|---|
| 6,679,301 | B2 | 1/2004 | Makino et al. | |
| 6,775,503 | B2 * | 8/2004 | Hattori et al. | 399/258 |
| 6,826,381 | B2 | 11/2004 | Muramatsu et al. | |
| 6,854,493 | B2 | 2/2005 | Ichikawa et al. | |
| 6,859,634 | B2 | 2/2005 | Itoh et al. | |
| 6,863,096 | B2 | 3/2005 | Amano | |
| 6,874,546 | B2 | 4/2005 | Amano et al. | |
| 6,981,530 | B2 | 1/2006 | Amano et al. | |
| 7,017,625 | B2 | 3/2006 | Amano et al. | |
| 2005/0244193 | A1 | 11/2005 | Amano et al. | |
| 2007/0212117 | A1 | 9/2007 | Itoh et al. | |

FOREIGN PATENT DOCUMENTS

| | | |
|---|---|---|
| JP | 2000-19830 | 1/2000 |
| JP | 2002-293301 | 10/2002 |
| JP | 2005-24622 | 1/2005 |
| JP | 2005-67651 | 3/2005 |
| JP | 2005-173388 | 6/2005 |
| JP | 2005-215655 | 8/2005 |
| JP | 2005-292300 | 10/2005 |
| JP | 2006-47972 | 2/2006 |
| JP | 2006-48009 | 2/2006 |
| JP | 2006-48010 | 2/2006 |
| JP | 2007-163793 | 6/2007 |

OTHER PUBLICATIONS

U.S. Appl. No. 11/679,949, filed Feb. 28, 2007, Hiroshi Sano, et al.
U.S. Appl. No. 11/679,964, filed Feb. 28, 2007, Hiroshi Sano, et al.
U.S. Appl. No. 11/098,705, filed Apr. 5, 2005, Hirosato Amano, et al.
U.S. Appl. No. 11/683,253, filed Mar. 7, 2007, Fumihito Itoh, et al.

* cited by examiner

POWDER TRANSPORT DEVICE AND IMAGE FORMING SYSTEM

BACKGROUND OF THE INVENTION

1. Field of the Invention

This invention relates to a powder transport device for use in an image forming devices, such as a copier, a facsimile or a printer. More specifically, this invention relates to a powder transport device including a mass powder storing part, and to an image forming system including the powder transport device.

2. Description of the Related Art

Conventionally, supply of toner to an image forming device is performed using a toner container which has a 0.5-2 liter capacity. This is because exchange of toner container is performed by the user and the use of the toner container having such capacity is considered suitable in the light of operability of the user.

However, if the toner container having such capacity is used, there is a problem that exchange of toner container must be performed frequently by a certain user, such as a print service company, who consumes a lot of toner.

Therefore, it is desired to reduce the frequency of exchange of toner container. To obviate the problem, Japanese Patent No. 3534159 discloses a toner device which is adapted for accommodating two or more toner containers. With this toner device, the period of consumption of all the toner containers can be prolonged. The empty-state toner containers can be exchanged even during image formation of the image forming device, and it is possible prevent operation of the image forming device from being stopped unnecessarily. However, if the capacity of each toner container in this toner device is the same, the frequency of exchange remains unchanged. Reducing the frequency of exchange of the toner containers is difficult for this toner device.

Moreover, the toner container disclosed in Japanese Laid-Open Patent Application No. 2005-024622 has a large capacity, and it is possible to reduce the exchange frequency of the toner container because of the large-capacity container. However, since toner is discharged from the lower part of this toner container and supplied to a toner receiving device, if separation or breakage of the toner piping occurs, much of the stored toner may be scattered.

Moreover, it is desired to increase the amount of storage of a mass toner storing container for heavy-consumption users to an amount larger than that of a conventional toner storing container. The increased amount of the storage mass toner storing container is, for example, in a range of 5-100 liters in capacity. However, toppling of the mass toner storing container may take place during conveyance or storage, earthquake, etc.

Furthermore, if an inexperienced worker mistakes connecting operation of the mass toner storing container at the time of exchange work, it is likely that the amount of scattering of the stored toner increases, the joint portion of the container is damaged.

SUMMARY OF THE INVENTION

According to one aspect of the invention, there is provided an improved powder transport device and image forming system in which the above-described problems are eliminated.

According to one aspect of the invention there is provided a powder transport device which is adapted to prevent the powder scattering and the toppling of the powder storing container and ensure easy exchange work.

In an embodiment of the invention which solves or reduces one or more of the above-mentioned problems, there is provided a powder transport device which transports powder to a powder receiving device by mixing the powder to an air flow, the powder transport device including a powder storing unit having a powder storing part which stores powder, and a container unit having a container part in which the powder storing unit is accommodated, the powder storing unit comprising: a motor part for operating the powder storing unit; an electrical wiring for transmitting an electric signal sent from the motor part or a driving current sent to the motor part in order to drive the motor part; and a first connector for providing electrical conduction between the electrical wiring and an external wiring, the container unit comprising a second connector electrically connected to the external wiring, the second connector being engaged with the first connector so that the first connector provides electrical conduction between the electrical wiring and the external wiring.

In an embodiment of the invention which solves or reduces one or more of the above-mentioned problems, there is provided a powder transport device which transports powder to a powder receiving device by mixing the powder to an air flow, the powder transport device comprising: a powder storing unit having a powder storing part which stores powder and having a first connector provided therein; and a container unit having a container part in which the powder storing unit is accommodated and having a second connector provided therein, wherein the powder transport device is constituted so that, when accommodation of the powder storing unit in the container part is completed, the first connector and the second connector are electrically connected together and transmission of an electric signal and/or a driving current between the powder storing unit and the container unit is allowed.

In an embodiment of the invention which solves or reduces one or more of the above-mentioned problems, there is provided an image forming system in which an image forming device and a powder transport device are provided, the powder transport device including a powder storing unit having a powder storing part which stores powder, and a container unit having a container part in which the powder storing unit is accommodated, the powder storing unit comprising: a motor part for operating the powder storing unit; an electrical wiring for transmitting an electric signal sent from the motor part or a driving current sent to the motor part in order to drive the motor part; and a first connector for providing electrical conduction between the electrical wiring and an external wiring, the container unit comprising a second connector electrically connected to the external wiring, the second connector being engaged with the first connector so that the first connector provides electrical conduction between the electrical wiring and the external wiring, wherein the image forming device performs image formation using the powder transported by the powder transport device.

According to embodiments of the powder transport device and the image forming system of the invention, it is possible to prevent the powder scattering and the toppling of the powder storing container and ensure easy exchange work.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

Figure 1:
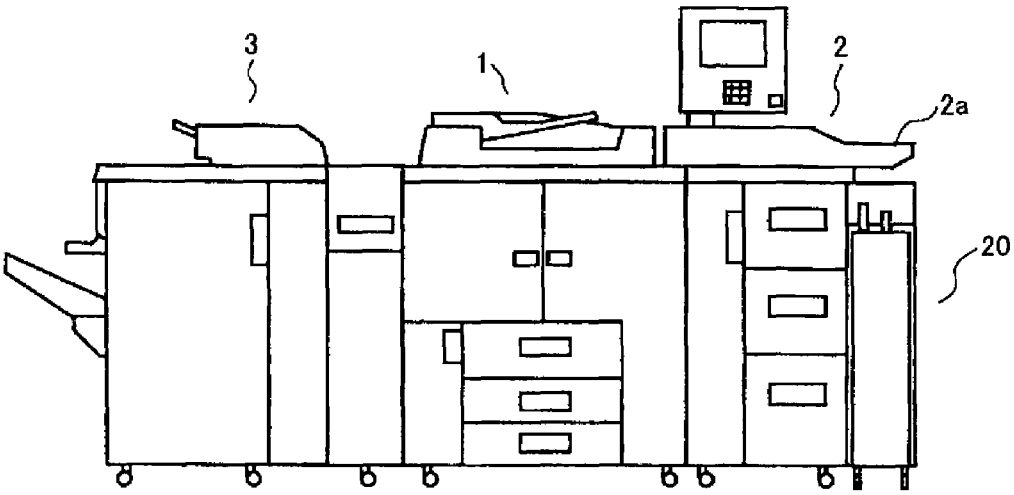
FIG. 1 is a diagram showing the composition of an image forming system in an embodiment of the invention.

FIG. 1 shows the composition of an image forming system in an embodiment of the invention.

In FIG. 1, reference numeral 1 denotes an image forming unit, reference numeral 2 denotes a sheet feeding unit, and reference numeral 3 denotes a post-processing unit which performs sorting, stapler fixing, etc.

The image forming unit 1 is an electrophotographic image forming device (copier) which uses powder toner for image formation. The sheet feeding unit 2 includes a wing 2*a* of the sheet feeding tray projecting on the right-hand side of the sheet feeding unit 2, and a powder transport device 20 which constitutes a toner supplying device and is provided beneath the wing 2*a* of the sheet feeding unit 2.

In addition, the installation position of the powder transport device 20 can be set up arbitrarily. However, in this embodiment, the dead space of sheet feeding unit 2 beneath the projecting wing 2*a* of the sheet feeding unit 2 is used as the installation position of the powder transport device 20.

The powder transport device 20 may be united with the image forming device. Alternatively, the powder transport device 20 may be detachably provided outside the image forming device. When the powder transport device 20 is provided inside the image forming device, the control of the powder transport device 20 by the image forming device can be performed easily. When the powder transport device 20 is provided outside the image forming device, the exchange of the powder transport device 20 can be performed easily at the time of failure of the powder transport device.

Figure 2:
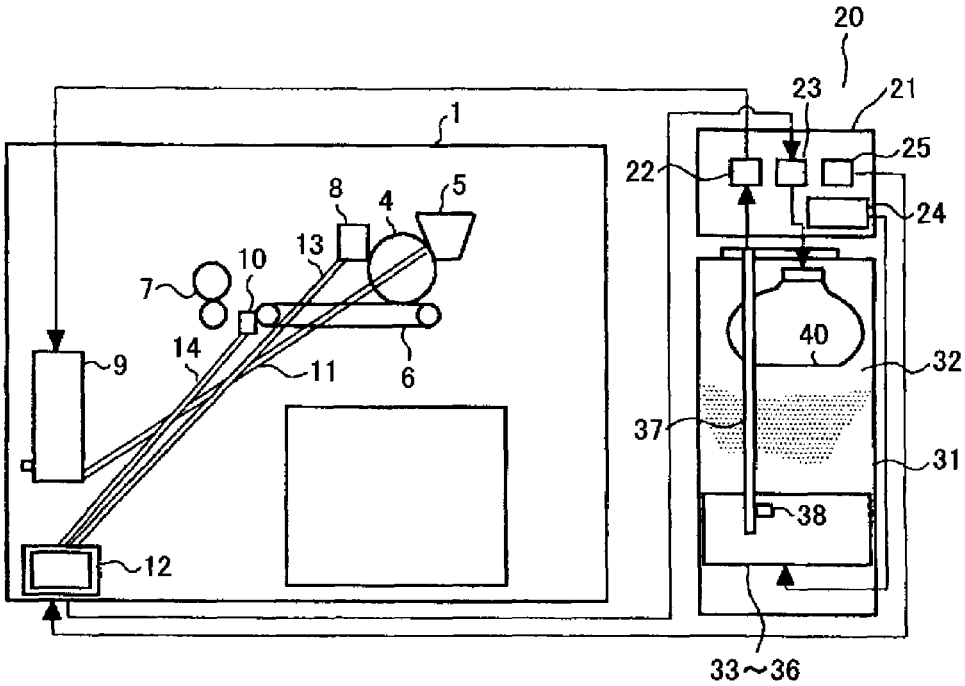
FIG. 2 is a diagram showing the connected state of a powder transport device and an image forming unit in this embodiment.
Figure 3:
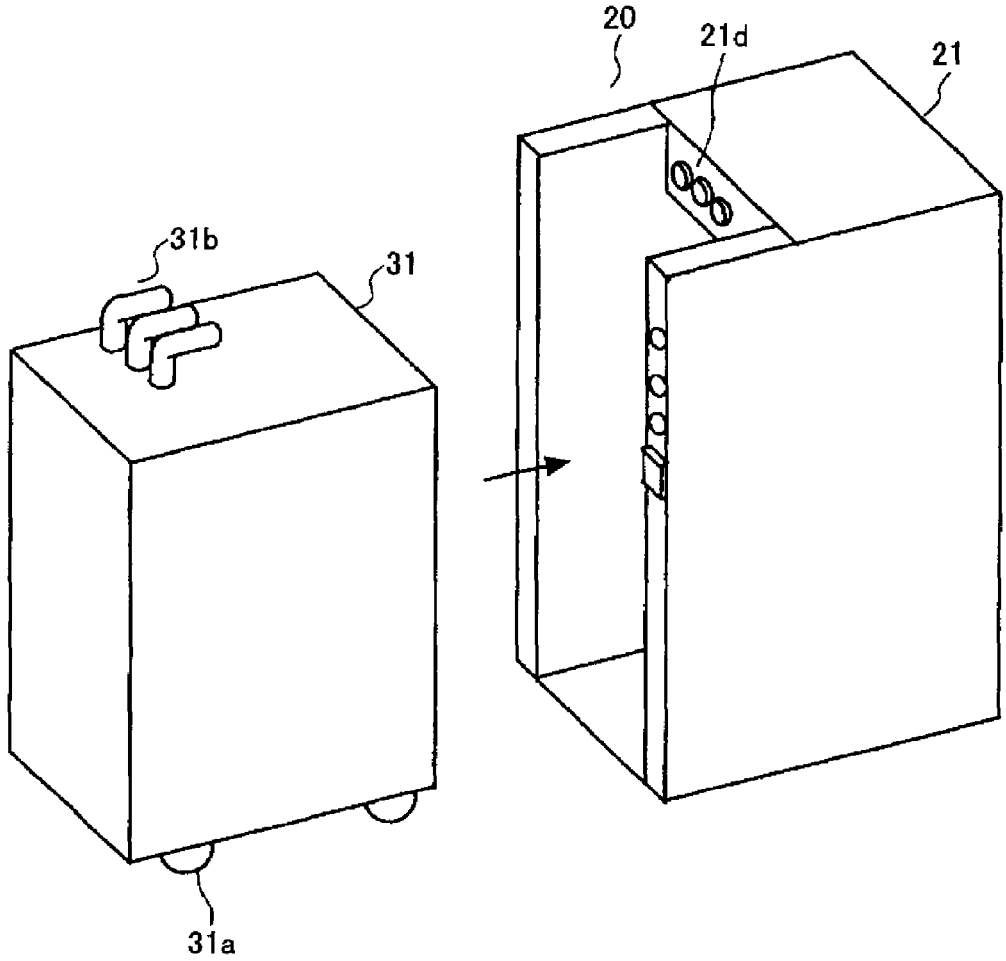
FIG. 3 is a perspective view of the powder transport device of this embodiment.
Figure 4C:
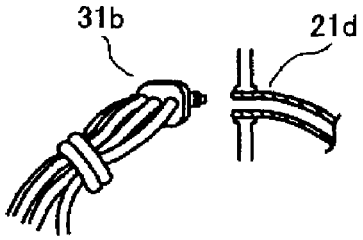
FIG. 4A, FIG. 4B, FIG. 4C and FIG. 4D are diagrams showing the installed state of a powder storing unit.
Figure 4A:
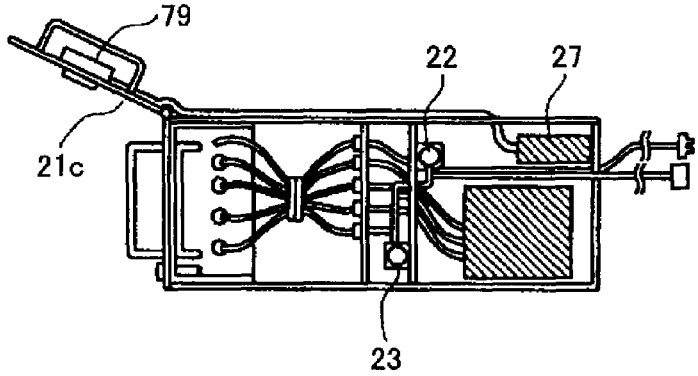
Figure 4D:
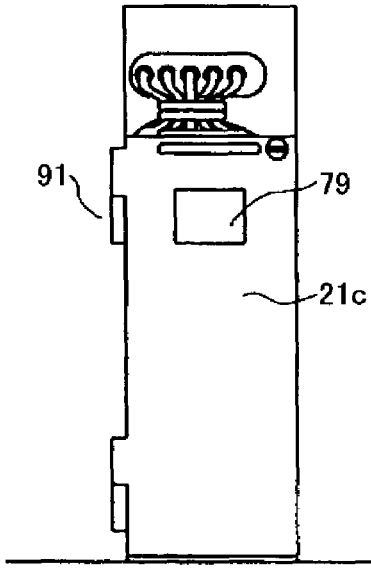
Figure 4B:
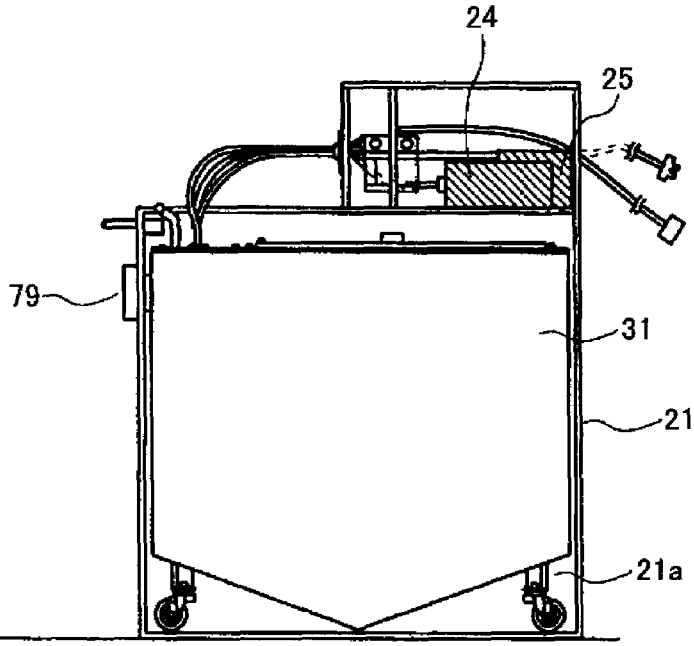

FIG. 2 shows the connected state of the powder transport device 20 and the image forming unit 1. FIG. 3 is a perspective view of the powder transport device 20.

In the image forming unit 1 of FIG. 2, a photoconductor drum 4 which is an image support object is provided. When the photoconductor drum 4 is rotated clockwise by the motor (which is not shown), the surface of the photoconductor drum 4 is uniformly charged by the charging device (which is not shown). The charged surface of the photoconductor drum 4 is exposed to scanning of a light beam (for example, a laser beam) applied thereto by the optical writing unit (not shown), so that an electrostatic latent image is formed on the surface of the photoconductor drum 4. This electrostatic latent image is turned into a visible image with toner by the developing device 5. The visible toner image is transferred to a recording medium (copy sheet), which is fed from and transported at predetermined timing by the sheet feeding part or the sheet feeding unit 2 (which is arranged at the lower part of the image forming device) by the transfer belt 6 which is a transfer device.

The recording medium to which the toner image is transferred is transported to the fixing device 7, so that the toner image is fixed to the recording medium permanently.

On the other hand, the remaining toner which remains on the surface of the photoconductor drum 4 is removed from the surface of the photoconductor drum 4 by the cleaning device 8. By repeating the above operations, image formation can be performed sequentially on a number of recording mediums. Moreover, the remaining toner of the transfer belt 6 is cleaned by the belt cleaning 10.

As shown in FIG. 2 and FIG. 3, the powder transport device 20 in this embodiment includes a container unit 21 which is fixed to the powder transport device 20, and a powder storing unit 31 which is detachably mounted to the container unit 21.

And the casters 31*a* are provided on the bottom of the powder storing unit 31 so that movement of the powder storing unit 31 can be done easily when it is detached from the container unit 21. In this powder storing unit 31, a powder storing part 32 in which the toner supplied to the image forming unit 1 is stored, and a waste toner recovery container 40 which is provided above the tank of the powder storing part 32. Moreover, the pumps 22 and 23 which transport toner and the air pumps 24 and 25 which supply air are provided in the container unit 21.

The toner supplied from the powder transport device 20 to the image forming unit 1 may be also transported to the development hopper (not shown) of the direct developer 4. However, in this embodiment, the toner is supplied to the toner hopper 9 which is provided in the image forming unit 1.

And the toner sent to the toner hopper 9 is transported to the development hopper of the developing device 5 through the transport passage 11 by the toner transport unit, such as a toner transport coil or a powder pump.

The connection between the powder transport device 20 and the powder storing unit 31 is performed through the powder storing unit connection part 31*b* and the container unit connection part 21*d* shown in FIG. 3.

The powder storing unit connection part 31*b* includes the suction nozzle and the air supply nozzle. In this embodiment, the powder storing unit connection part 31*b* is connected to the container unit connection part 21*d*.

Thereby, while the toner of the powder storing part 32 is not scattered, it can be supplied through the powder storing unit 31 and the powder transport device 20 to the developing device 5 of the image forming device. Moreover, air can be supplied from the air pumps 24 and 25 to the powder storing part 32.

FIG. 4A, FIG. 4B, FIG. 4C and FIG. 4D show the installed state of the powder storing unit 31. As shown, the powder storing unit connection part 31*b* is fixed with the connecting member in which the suction nozzle and the air supply nozzle are united, and the connecting member of the powder storing unit connection part 31*b* is connected to the container unit connection part 21*d*. Accordingly, the effect to prevent an inexperienced worker from mistaking the connecting operation can be increased, and the scattering of the stored toner can be prevented more efficiently. Furthermore, because of the use of the connecting member which is connected to the container unit connection part 21*d*, the working efficiency of the connecting operation can be increased.

Figure 5:
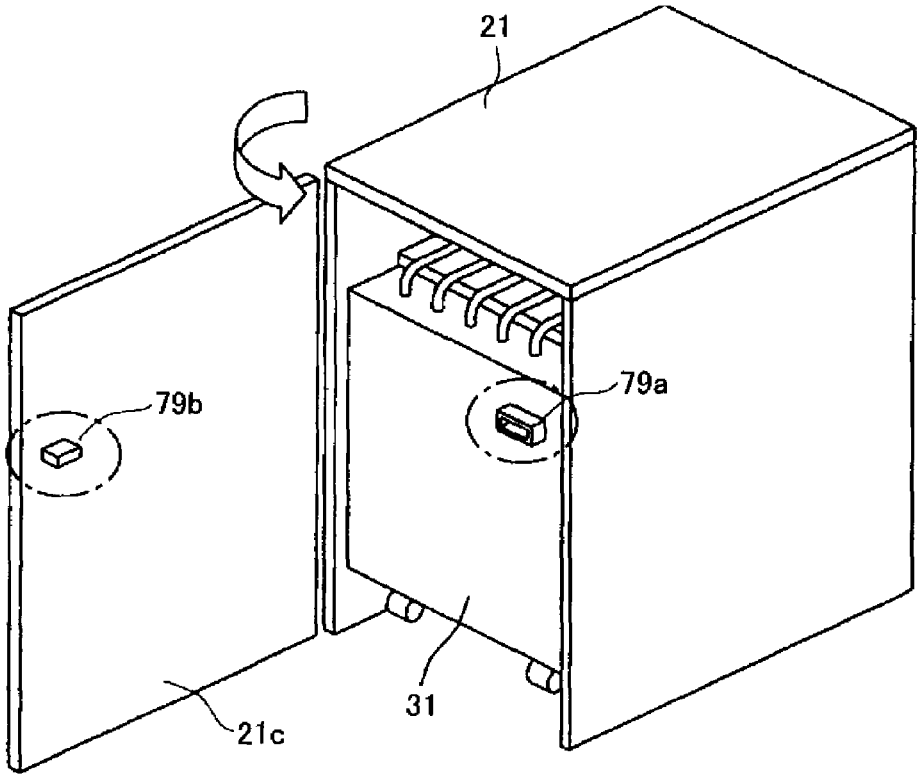
FIG. 5 is a diagram showing the arrangement of electrical wiring connectors in the powder transport device of this embodiment.

FIG. 5 shows the arrangement of the electrical wiring connectors in the powder transport device of this embodiment.

As shown in FIG. 5, the drawer connector 79*a* is provided on the powder storing unit 31 as a first connector, and the drawer connector 79*b* is provided on the container unit 21 as a second connector.

The electric supply path is formed by using the drawer connectors 79*a* and 79*b*. The electrical wiring and connectors for driving the electrical parts including the air pump which supplies air through the porous member and the detection sensor are provided in the container unit. The driving current from the power supply outside the powder storing unit 31 can be supplied to the air pump, and the detection result from the detection sensor can be transmitted to the container unit 21 or the CPU provided in the image forming device.

The positions where the electrical wiring connectors 79*a* and 79*b* are arranged are determined arbitrarily. However, it is preferred that, as shown in FIG. 5, the first connector 79*a* is provided on the side surface of the powder storing unit 31, and the second connector 79*b* is provided on the back surface of the door of the container unit 21.

In a case in which the connector connects the large-sized powder storing unit 31 is contained in the container part, if the composition in which the connector at the insertion place is connected is adopted, the insertion place cannot be seen from the user. The connecting operation may be mistaken by the user, and the load exceeding the withstand load of the connector may be exerted around the connector by the force of inertia by the weight of the container unit. There is a problem that the connector and the surrounding mechanism may be damaged by the unsuitable connecting operation of the user.

However, with the use of the composition of FIG. 5, electric connection can be recovered in accordance with the door closing operation, and the connector is pressed by the member with a comparatively light weight which is provided on the back surface of the door of the container unit 21 and can be easily recognized by the user. Therefore, it is possible to prevent the damaging of the connector by the unsuitable connecting operation of the user.

Moreover, the presence of the powder storing unit 31 can be easily checked by the user, and the malfunction of the powder transport device in the state where the powder storing unit 31 is vacant can be prevented, and the toppling of the container unit during storage, earthquake, etc. can be prevented.

Figure 6:
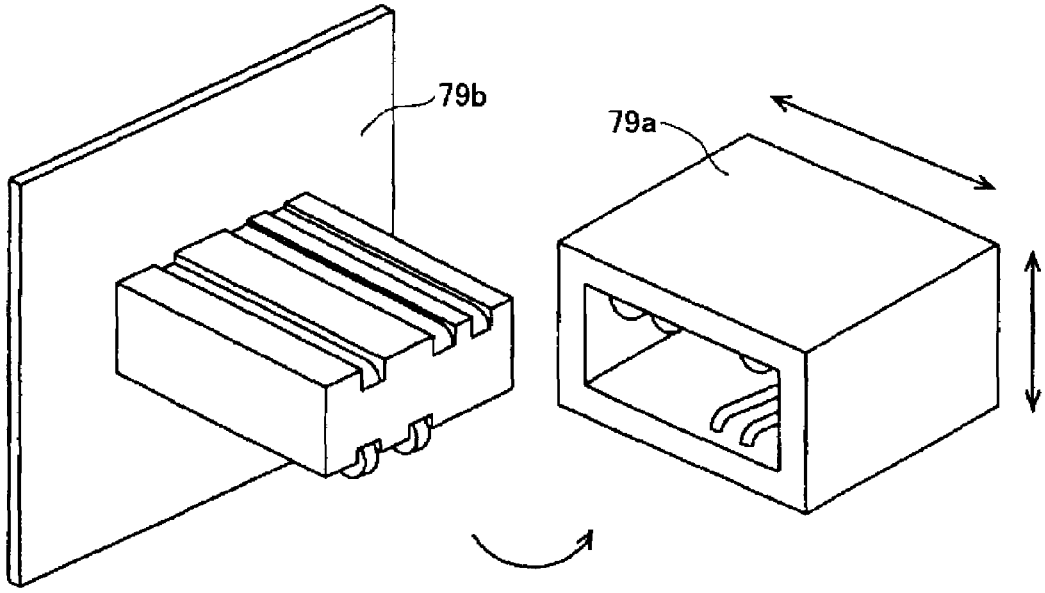
FIG. 6 is an enlarged view of the electrical wiring connectors in the powder transport device of this embodiment.
Figure 7A:
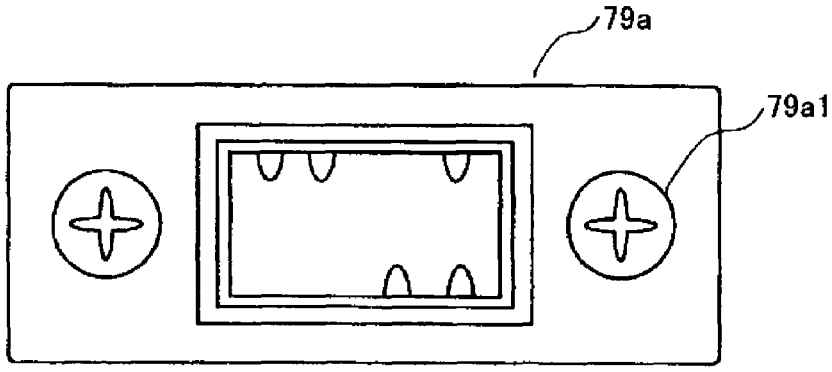
FIG. 7A and FIG. 7B are diagrams showing the composition of the electrical wiring connector.
Figure 7B:
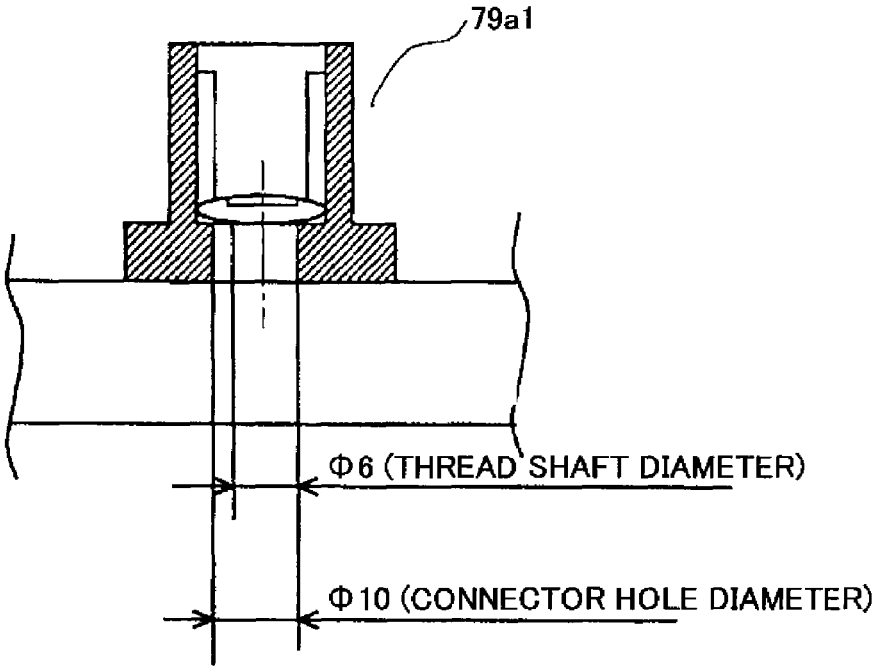

Next, the electrical wiring connectors 79*a* and 79*b* in this embodiment will be explained. FIG. 6 is an enlarged view of the electrical wiring connectors 79*a* and 79*b*. FIG. 7A and FIG. 7B show the composition of the electrical wiring connector 79*a*.

As shown in FIG. 6, the electrical wiring connector 79*a* is movable vertically and horizontally. Specifically, a clearance between the shaft diameter of the screw 79*a*1 and the hole diameter of the drawer connector 79*a* is provided as shown in FIG. 7B, and the electrical wiring connector 79*a* can be moved vertically and horizontally. Therefore, the fine gap between the positions of the connectors 79*a* and 79*b* can be adjusted. The connecting operation of the connectors 79*a* and 79*b* can be performed smoothly and easily. Moreover, it is possible to prevent the damaging of the connectors 79*a* and 79*b* by unsuitable connection of the connectors 79*a* and 79*b* by the user.

Figure 8:
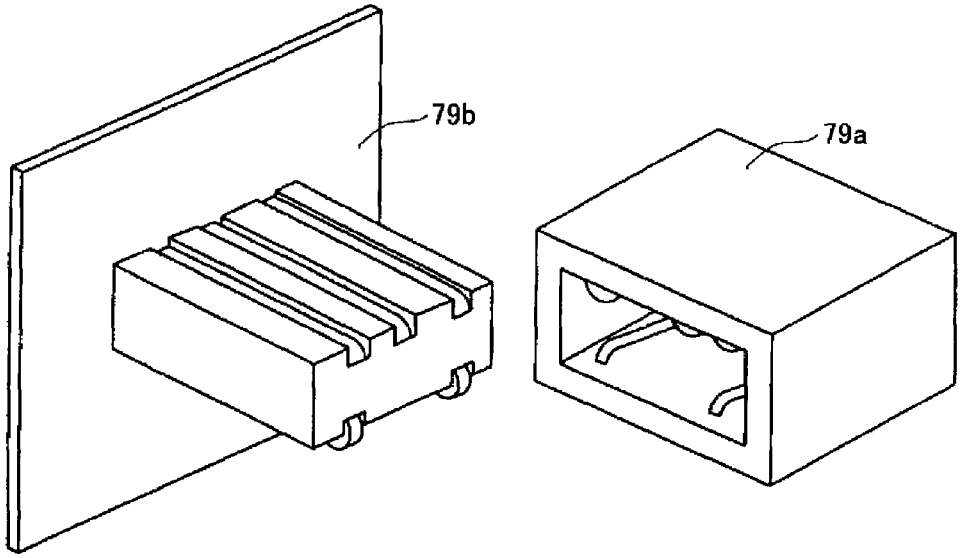
FIG. 8 is a diagram showing the electrical wiring connectors in which the arrangement of pins is changed to set the connectors in a non-compatible state.
Figure 9:
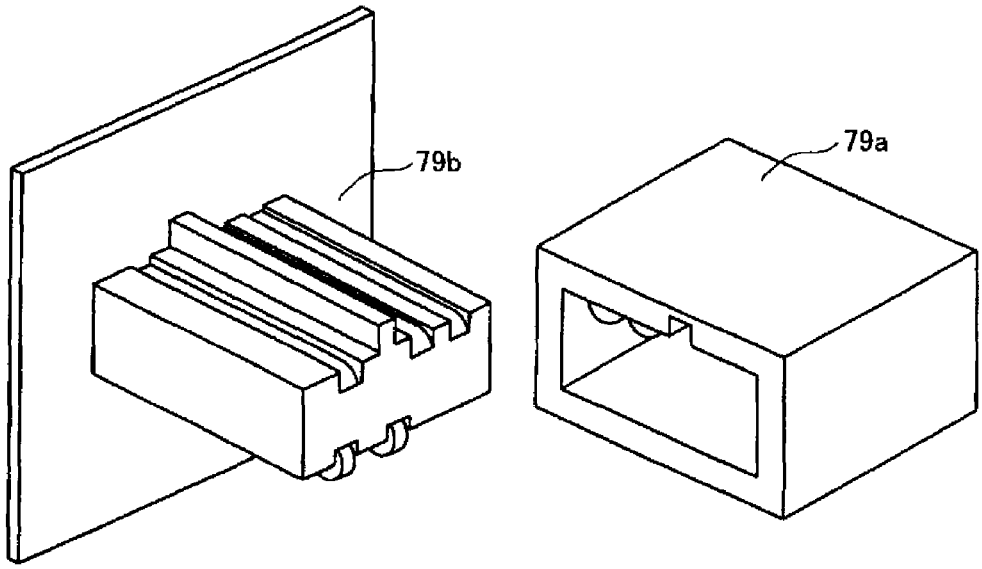
FIG. 9 is a diagram showing the electrical wiring connectors in which the shape is changed to set the connectors in a non-compatible state.

FIG. 8 shows the electrical wiring connectors in which the arrangement of pins is changed to set the connectors in a non-compatible state. FIG. 9 shows the electrical wiring connectors in which the shape is changed to set the connectors in a non-compatible state.

The door 21*c* of the container unit 21 is not fitted to the powder storing unit 31 by changing the pin arrangement or the connector shape. It is ensured that only the powder storing unit 31 which is tuned up to the container units 21 is selected by the user who performs the connecting operation of the connectors.

For example, suppose that the problem of an image with excessive background stain arises by the performance of a specific image forming device, and it is necessary to change the charging characteristics of the toner which is filled up in the corresponding powder storing unit 31 to a level higher than the normal level at the time of shipment. In such a case, if the shape of the connectors 79*a* and 79*b* is changed and such connectors are attached to the powder storing unit 31 and the container unit 21, then it is possible to prevent the incorrect toner storing by confusion of the improved powder storing unit and the normal powder storing unit.

Figure 10:
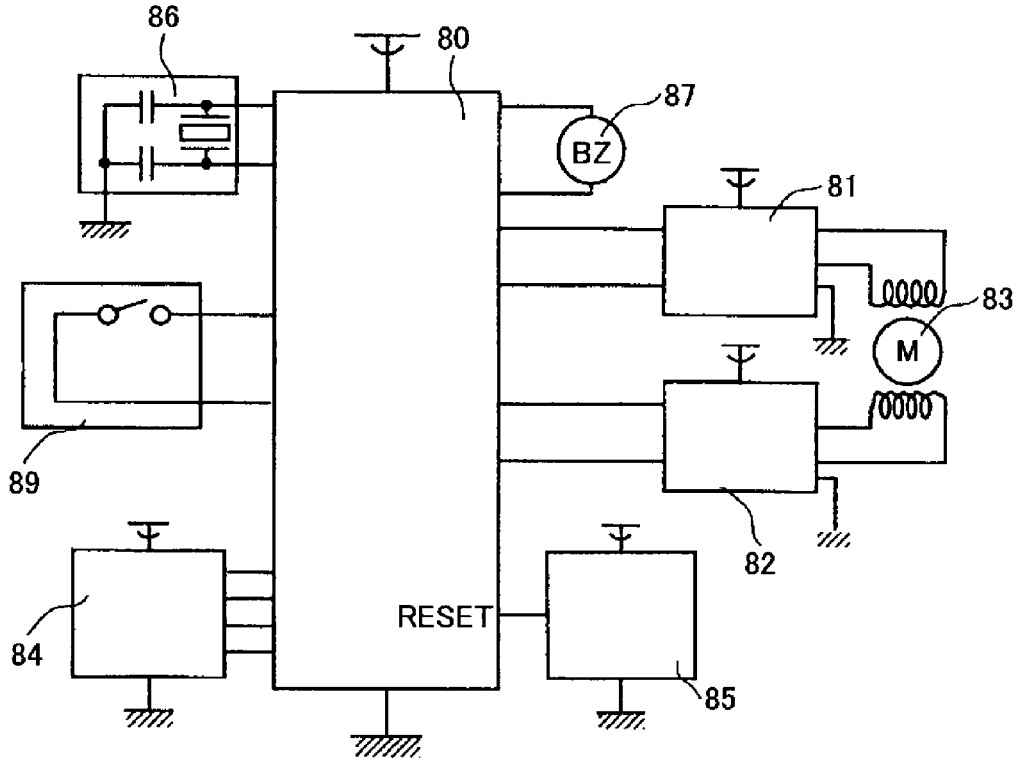
FIG. 10 is a diagram showing the electrical circuit of an electronic lock when the powder transport device is provided with the electrical wiring connectors.

FIG. 10 shows the electrical circuit of an electronic lock when the powder transport device is provided with the electrical wiring connectors.

In FIG. 10, reference numeral 80 denotes a MPU (microprocessor unit), and reference numerals 81 and 82 denote motor drive circuits for rotating the stepping motor 83. The rotation of the stepping motor 83 in the forward or reverse rotation direction can be controlled freely by changing the phases $\psi 1$ and $\psi 2$ of the driving pulses outputted from the motor drive circuits 81 and 82.

Moreover, in FIG. 10, reference numeral 84 denotes an EEPROM (memory) which stores the control program and the password, reference numeral 85 denotes a power-on-reset circuit which resets the electrical circuit of the electronic lock to its initial state automatically at the time of power up, reference numeral 86 denotes a time constant circuit for a clock oscillation, reference numeral 87 denotes an electronic buzzer, and reference numeral 89 denotes a detection circuit which detects connection of the electrical wiring connectors.

When the powder storing unit 31 is contained in the container unit 21 and the door 21*c* of the container unit 21 is shut, the door 21*c* of the container unit 21 and the powder storing unit 31 are connected together by the electrical wiring connectors 79*a* and 79*b*. When the connection of the electrical wiring connectors 79*a* and 79*b* is detected by the detection circuit 89, the detection information is transmitted from the circuit 89 to the MPU 80 so that the locking of the door 21*c* is performed.

Since the powder storing unit 31 in this embodiment is a large-sized powder storing unit 31, it is expected that various operations, such as clearing up of the surrounding units, are performed at the time of setting of the powder storing unit 31. If an operation start switch is provided at a different position, it is likely that the locking of the door 21*c* may be forgotten because the operation of turning on and off the switch must be performed.

However, with the use of the above-mentioned electronic lock of FIG. 10, it is possible to preventing failure of the locking operation of the door 21*c*. And it is possible to prevent the mistaking of the connecting operation by an unfamiliar user and the theft of the powder storing unit 31 during automatic operation.

Figure 11:
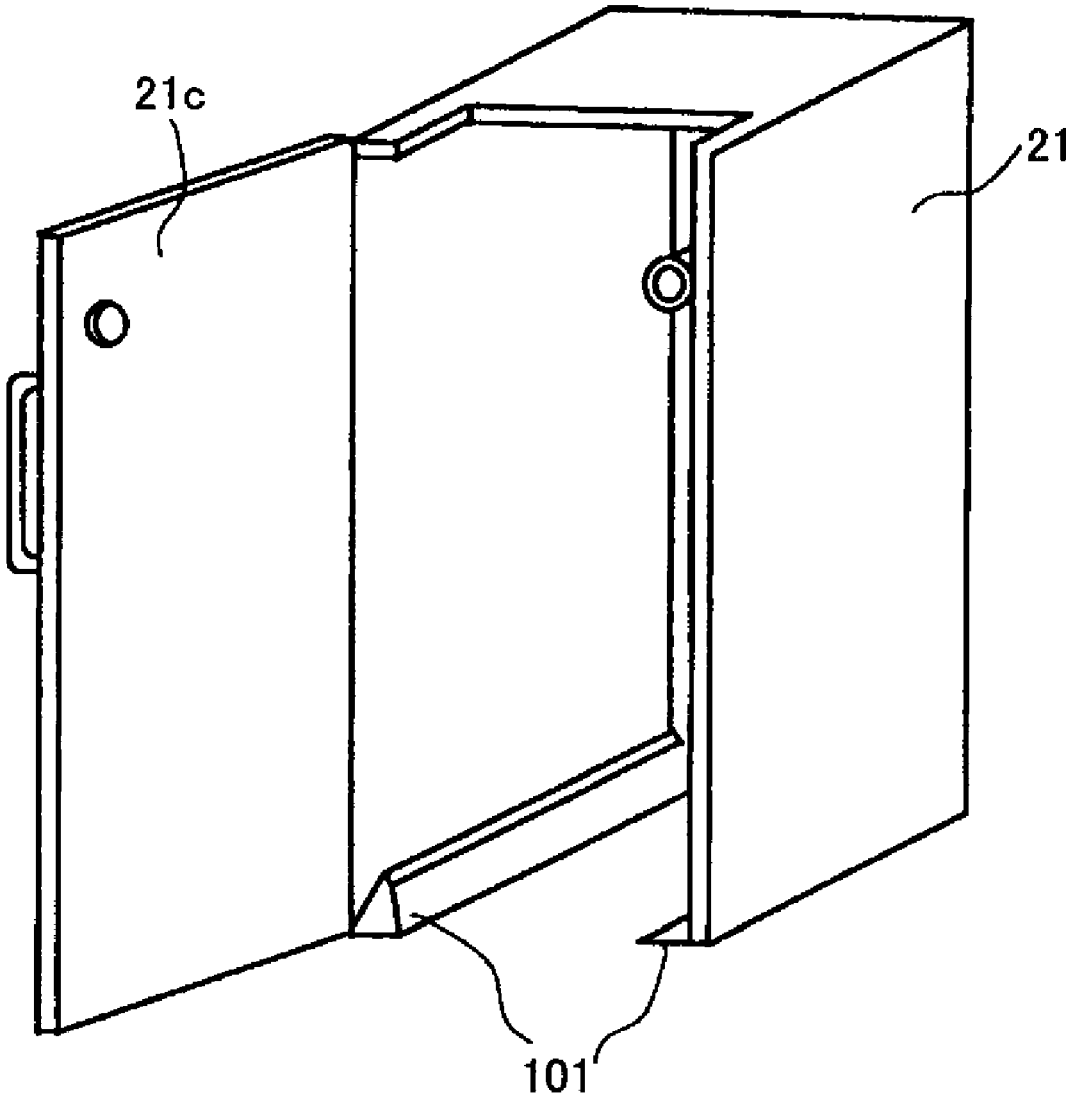
FIG. 11 is a diagram showing a container unit which has a regulation member which regulates the direction of movement of the casters.

FIG. 11 shows the container unit 21 which has a regulation member which regulates the direction of movement of the casters. As shown, the regulation members 101 which regulate the direction of movement of the casters 31*a* are provided at both the side ends of the bottom of the container unit 21.

Figure 12:
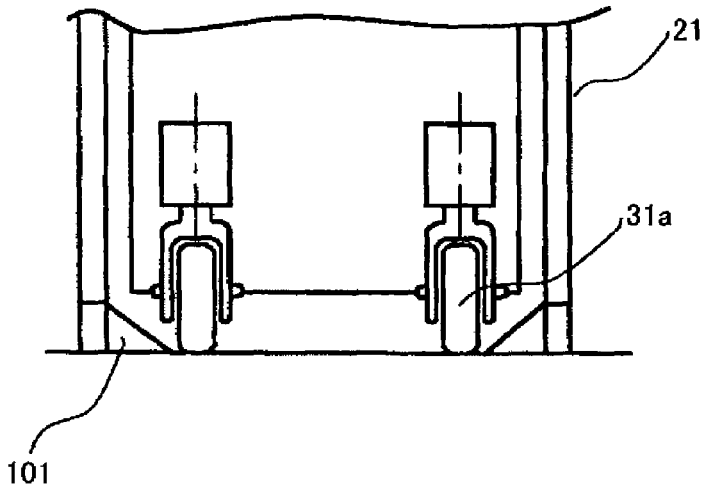
FIG. 12 is a diagram for explaining the regulation of horizontal rotation of the caster wheels by the regulation member.

FIG. 12 is a diagram for explaining the regulation of the horizontal rotation of the caster wheels.

When the casters 31*a* are rotated in the horizontal direction even if the side of the powder storing unit 31 is regulated, it is difficult to smoothly move the powder storing unit 31 into the container unit 21.

In the powder storing unit 31 of this embodiment, the rotation of the casters 31*a* in the horizontal direction is regulated, and it is possible to move the powder storing unit 31 into the container unit 21 along the regulation members 101 or carry the powder storing unit 31 on the regulation members 101.

When the powder storing unit 31 is carried on the regulation members 101, the distance between the regulation members 101 can be set up to be equal to or slightly greater than the distance between the casters of the powder storing unit 31. For this reason, accommodation of the powder storing unit 31 in the container unit 21 may be carried out by locking the movement of the casters 31*a* and moving the regulation members 101 or by moving the regulation members 101 using the casters 31*a*.

Thereby, it is possible to easily carry out setting of the powder storing unit 31 in the predetermined position in the container unit 21 and engagement of the connectors 79*a* and 79*b* by the closing operation of the door 21*c* of the container unit 21. Moreover, even an operator with little power can easily carries out accommodation of the heavy powder storing unit 31, and it is possible to prevent the toppling of the powder storing unit 31.

Figure 13:
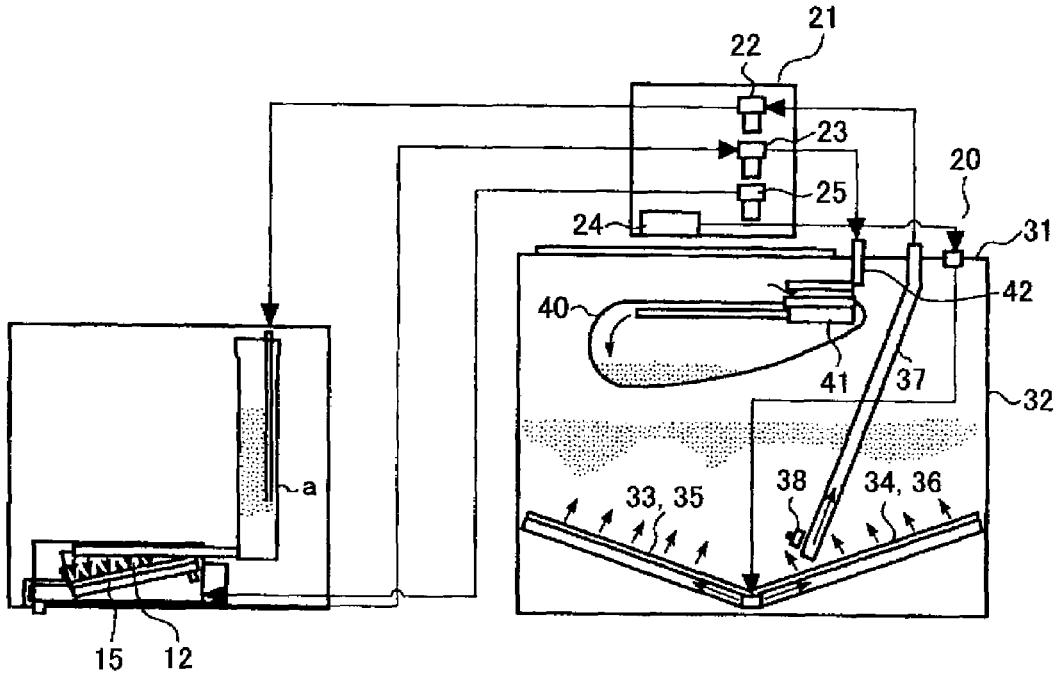
FIG. 13 is a diagram showing the internal composition of the powder transport device of this embodiment.

FIG. 13 shows the internal composition of the powder transport device 20 of this embodiment.

As shown in FIG. 13, the powder storing part 32 of the powder storing unit 31 is provided with an inclined floor having a V-shaped cross section. The inclination angle of the inclined floor of the powder storing part 32 may be set up to be smaller than the toner resting angle. In this embodiment, the inclination angle is set to about 20 degrees and the toner resting angle is set to about 40 degrees. If the inclination angle of the floor is set to a loose angle, it is possible to make the dead space by inclination small.

Figure 14:
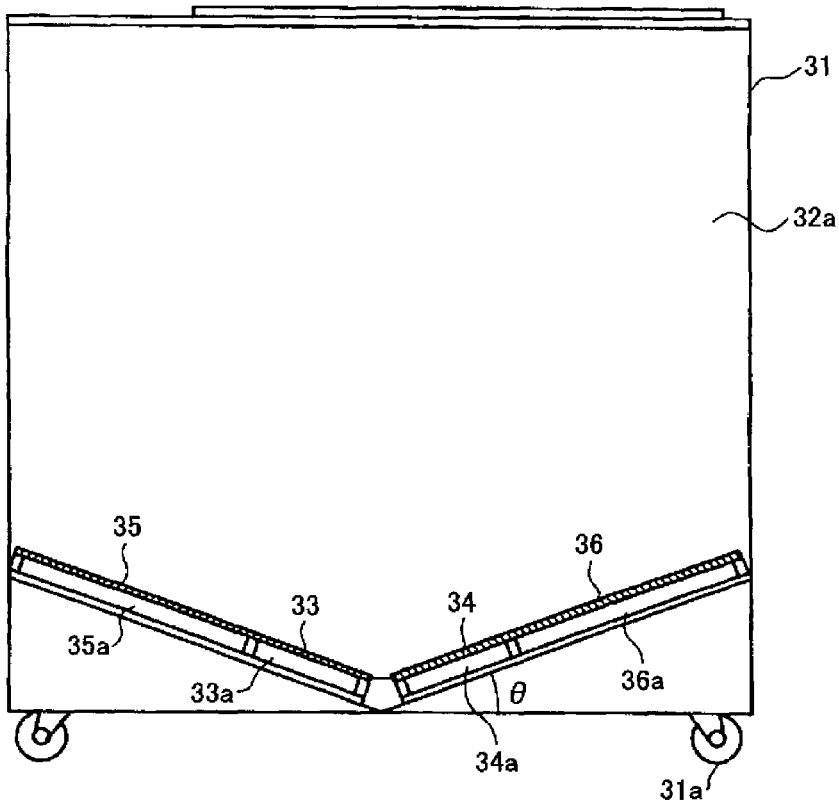
FIG. 14 is a diagram showing the composition of the powder storing unit.

FIG. 14 shows the composition of the powder storing unit 31. As shown in FIG. 14, a flowable floor (which constitutes an air jet member), including porous members 33, 34, 35, and 36, is provided in the floor of the powder storing part 32 of the powder storing unit 31. The powder storing part 32 in this embodiment can secure the space adequate for storing a large amount of toner by making the cross-sectional shape into a rectangle.

The porous members 33-36 are fine porous members that can pass air, and it is desirable that the open area ratio of the porous members 33-36 is in a range from 5 to 40%. And it is more desirable that the open area ratio of the porous members 33-36 is in a range from 10 to 20%.

Moreover, since the volume average particle diameter of the toner commonly used is in a range of 3-15 micrometers, it is desirable that the average opening diameter of the porous members 33-36 is in a range of 0.3-20 micrometers. And it is more desirable that the average opening diameter of the porous members 33-36 is in a range of 5-15 micrometers.

Moreover, it is desirable that the average vacancy diameter of the holes of the porous members 33-36 is 0.1 to 5 times as large as the volume average particle diameter of the toner concerned. And it is more desirable that the average vacancy diameter of the holes of the porous members 33-36 is 0.5 to 3 times as large as the volume average particle diameter of the toner concerned. As a material of the porous members 33-36, there is no restriction and it can be chosen suitably according to the purpose.

For example, the material of the porous members 33-36 may be any of a sintered material of glass and resin particles, a photo-etched resin, a porous resin material, such as resin punched thermally, a sintered metal material, a punched sheet-metal material, etc.

The air chambers 33*a*, 34*a*, 35*a*, and 36*a* connected to the air pump 24 are provided in the lower part of the porous members 33-36. Moreover, the porous members 33, 34, 35, and 36 are set up so that the area of the lower porous members 33 and 34 is smaller than that of the upper porous members 35 and 36. Similarly, the air chambers 33*a*, 34*a*, 35*a*, and 36*a* are set up so that the chamber capacity of the lower chambers 33*a* and 34*a* is smaller than that of the upper chambers 35*a* and 36*a*.

Upon start of operation of the air pump 24, air is blown off through the air chambers 33*a*, 34*a*, 35*a*, and 36*a* from the porous members 33, 34, 35, and 36 which are flowable floors and the air is supplied to the toner stored so that the toner is mobilized. And the mobilized toner is attracted by the pump 22 from the toner suction pipe 37 and transported to the toner hopper 9 provided in the image forming unit 1. At this time, the toner is attracted upwards from near the lowest position of the powder storing part 32, and most of the toner stored can be attracted and transported.

Furthermore, when the toner is attracted upwards, it is transported to the image forming unit 1 which is located at a position higher than the storage position of the powder storing part 32. For this reason, even when a separation or damage of the transport pipe between the powder transport device 20 and the image forming unit 1 occurs accidentally, it is possible to prevent scattering of the toner in the powder storing part 32, and it is minimized to scattering of a small amount of toner passed through the transport pipe.

As described above, since the capacity of the lower chambers 33*a* and 34*a* is smaller than that of the upper chambers 35*a* and 36*a* and the area of the lower porous members 33 and 34 is smaller than that of the upper porous members 35 and 36, if an equivalent amount of air is supplied to each air chamber 33*a*, 34*a*, 35*a*, and 36*a*, the air blown off from the lower porous members 33 and 34 will become more uniform than the air blown off from the upper porous members 35 and 36. Therefore, the toner attracted with the toner suction pipe 37 can be mobilized certainly.

In addition, the sensor which detects the existence of toner is provided near the suction opening of the toner suction pipe 37 as a near-end sensor 38. Moreover, a filter which prevents the internal pressure in the powder storing part 32 from being increased excessively by the air supplied is provided in the upper part of the powder storing part 32.

If the filter is located above the full-state line of the toner in the powder storing part 32, the installed position of the filter is not limited to the upper part of the powder storing part 32.

For example, the filter may be disposed at the side part of the powder storing part 32. The material of the filter may be the same as the material of the porous member. Or, the filter may be made of a sheet of Gore-Tex (brand name, registered trademark) manufactured by Japan Gore-Tex company, which is a continuous porosity structure material made of a fluoro-resin.

The toner transported to the toner hopper 9 of the above-mentioned image forming unit 1 from the powder storing part 32 of the powder transport device 20 is transported to the development hopper of the developing device 5 through the transport passage 11, so that the toner image is formed by the development using the toner supplied.

In the powder transport device 20, the powder storing unit 31 can be removed from the fixed unit 21 and moved. If the toner in the powder storing part 32 becomes empty mostly, the powder storing unit 31 of the powder storing part 32 may be exchanged with a new powder storing unit 31 which is filled up with toner.

And the power supply of the powder storing unit 31 is separate from the power supply of the image forming unit 1, and if toner remains in the image forming unit 1 in part, the powder storing unit 31 may be exchanged with new one, without turning off the power supply of the image forming unit 1.

By the way, several percent of the toner which adhered to the photoconductor 4 by development is not transferred by recording media, such as a decalcomania paper, but remains to the photoconductor 4. The remains toner is removed by the cleaning device 8.

Moreover, dirt, such as toner adhering to the transfer belt 6, is removed by the belt cleaning 10. Conventionally, when it accumulated in the recovery container provided in data processing apparatus by using as waste toner the toner removed by these cleanings and the recovery container filled, operation of machinery is stopped and it is exchanging for a new recovery container.

If 30-40 kg of toner shall be stored to the powder storing part 32 of the above-mentioned powder transport device 20 as it is this composition, and about 10% of photoconductor adhering toners shall remain, when the toner is exhausted, about 3-4 kg of waste toner will be collected.

Therefore, even if it is about 10 kg with capacity of a recovery container large-sized for the heavy user who consumes about 30 kg of toner in one month, it must exchange every 2 or 3 months, and the work is troublesome.

Moreover, enlarging the capacity of the recovery container and reducing exchange frequency may be considered, but the capacity of the recovery container provided in the image forming unit 1 is limited and it is difficult to enlarge the capacity.

In this embodiment, the waste toner recovery container 40 which stores waste toner etc. is formed in the powder storing unit 31, the toner collected in cleaning of the image forming unit 1 is sent to the waste toner recovery container 40, and the advantage of exchange of the powder storing unit 31 is taken, and it collects.

The toner which formed the exhausting part 12 in the image forming unit 1, and specifically sent the toner removed by the cleaning device 8 through the transport passage 13, and is removed by the belt cleaning 10 is sent through the transport passage 14, and is once brought together in the exhausting part 12.

The flowable floor made of the porous member 15 is provided in the floor of the exhausting part 12 like the powder storing part 32, and air is blown off from the porous member 15 using the air pump 25.

The recovery toner which has little mobility is mobilized by the air blowing off, and it can be easily transported to the powder transport device 20 by the suction of the pump 23. Since the waste toner recovery container 40 provided in the powder storing unit 31 should just have the amount of recovery determined by the amount of toner accumulated in the tank, the large capacity is unnecessary and there is no need to consider the withstanding strength against the impact from the outside.

Therefore, the waste toner recovery container 40 may be made of a flexible resin bag, for example, a plastic bag, etc.

Although the waste toner recovery container 40 is attached to the set part 41 with an elastic band etc., the piping 42 into which waste toner is sent, and the filter 43 which extracts air are provided in the set part 41.

Thus, the piping 42 and the filter 43 can be attached to the waste toner recovery container 40 by a single operation because the piping 42 and the filter 43 are provided in the set part 41.

As explained above, the large-scaled powder storing unit 31 is detachably provided to the container unit 21 in this embodiment, and blowing off air from the bottom of the powder storing part 32 through the air jet members (porous members) 35 and 36, using the pump 22, and the toner is attracted from the suction opening of the toner suction pipe 37, and it is breathing out to the toner hopper 9 (the toner receiving unit).

And the powder transport device of this embodiment is provided so that, when accommodation of the powder storing unit 31 in the container unit 21 is completed (or when the door 21*c* is closed), the first connector 79*a* and the second connector 79*b* are electrically connected together and transmission of an electric signal or/and a driving current between the powder storing unit 31 and the container unit 21 is allowed. Therefore, it is possible to prevent the toner scattering and the toppling of the powder storing unit and ensure easy exchange work.

Figure 15:
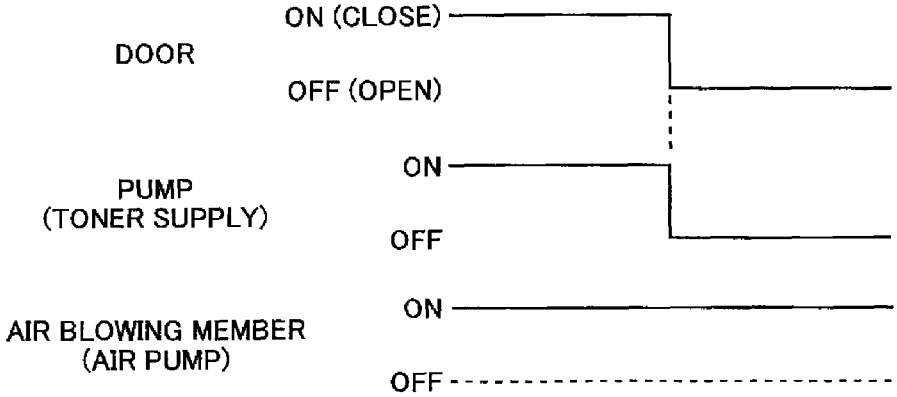
FIG. 15 is a timing chart for explaining the control process performed by the powder transport device in an embodiment of the invention.

FIG. 15 is a timing chart for explaining the control process which is performed by the powder transport device in an embodiment of the invention.

Similar to the previous embodiment, the powder transport device 20 of this embodiment includes the container unit 21, and the large-scaled powder storing unit 31 which is detachably attached to the container unit 21. And blowing off air from the bottom of the powder storing part 32 by the air jet members (porous members) 35 and 36, using the pump 22, the toner in the powder storing part 32 is attracted from the suction opening of the toner suction pipe 37, and supplied to the toner hopper 9 (the toner receiving unit).

Similar to the previous embodiment, when accommodation of the powder storing unit 31 in the container unit 21 is completed in this embodiment, the first connector 79*a* and the second connector 79*b* are electrically connected together, and transmission of an electric signal or/and a driving current between the powder storing unit 31 and the container unit 21 can be performed.

Specifically, when the powder storing unit 31 is accommodated in the container part of the container unit 21 and the opening of the container unit 21 is closed by the door 21*c*, engagement (electrical connection) between the first connector 79*a* provided in the powder storing unit 31 and the second connector 79*b* provided in the door 21*c* is performed.

Moreover, similar to the previous embodiment, if the closing of the door 21*c* and the engagement of the first connector 79*a* and the second connector 79*b* are carried out in this embodiment, the door 21*c* is locked by an electronic lock (see FIG. 10) which is interlocked with the engagement of the first connector 79*a* and the second connector 79*b*.

In addition, the electric signal or/and the driving current which are exchanged between the powder storing unit 31 and the container unit 21 when the first connector 79*a* and the second connector 79*b* are connected electrically, are not limited to those in the previous embodiment (which are the electric signal sent by the motor part and the driving current sent to the motor part). The electric signal or/and the driving current may be any of various signals or currents. For example, when the first connector 79*a* and the second connector 79*b* are connected, an electric signal allowing for the image forming device 1 (or powder transport device 20) to detect that the powder storing unit 31 is accommodated in the container unit 21 may also be exchanged.

In this embodiment, even when the powder storing unit 31 is accommodated in the container part of the container unit 21, the powder transport device is controlled so that the toner stored in the powder storing part 32 is not transported to the toner hopper 9 which is the toner receiving unit, if the door 21*c* is opened.

Specifically, as shown in FIG. 15, the pump 22 is controlled so that operation of the pump 22 is allowed only when the door 21*c* is closed (ON) and the first connector 79*a* and the second connector 79*b* are engaged together.

By performing such control, it is possible to avoid the problem that the pump 22 is operated erroneously before the exchange work of the powder storing unit 31 is completed.

If the operation of the pump 22 is allowed in response to the toner supply signal transmitted by the image forming device 1, in the state where the door 21*c* is opened and the transport pipe (tube) which connects the pump 22 and the toner suction pipe 37 is removed in the exchange work of the powder storing unit 31, the toner will be ejected reversely from the removed transport pipe and scattered, or the toner will be scatters from the clearance of the housing of the toner hopper 9 in which air is fed so much by the pump 22.

To obviate the problem, in this embodiment, when the door 21*c* is opened (OFF) and the first connector 79*a* and the second connector 79*b* are not connected, the operation of the pump 22 is compulsorily stopped irrespective of the presence of a toner supply signal. Thus, it is possible to prevent the above-mentioned problem certainly.

Moreover, in this embodiment, the air pump 24 and the air jet members (flowable floor) 35 and 36 are controlled so that the operation of the air jet is allowed irrespective of opening or closing of the door 21*c*.

Specifically, the air pump 24 for supplying an air jet from the porous members 35 and 36 is controlled so that the operation of the air pump 24 is allowed even when the door 21*c* is opened. In the exchange work of the powder storing unit 31, the problem, such as toner scattering, does not arise even if the air pump 24 works in the state where the door 21*c* is opened and the transport pipe (tube) which connects the air pump 24 and the air chamber 33*a*-36*a* is removed. Rather, mobilization of the toner in the powder storing part 32 will be promoted more by operating the air pump 24 also when the door 21*c* is opened.

As explained above, it is possible for this embodiment to prevent the toner scattering and the toppling of the powder storing container and ensure easy exchange work.

In the above-described embodiment, the powder transport device 20 is applied to transport toner to a toner receiving device. It is a matter of course that the powder transport device of the invention is applicable also to transport a 2-component developing agent, containing a toner and a carrier, to a powder receiving device. In this case, a permeability sensor may be used as a detection unit which detects the amount of the remaining 2-component developing agent in the powder storing part 32.

Furthermore, the powder transport device of the invention is applicable to the following powder transport devices: (1) a powder transport device which supplements a resin molding machine with molding material (pellet supplement machine); (2) a powder transport device which transports flour, manure, livestock food, etc.; (3) a powder transport device used at a manufacture spot to transport medicine of powder or fluid, tablets, cosmetics, such as face powder, etc.; (4) a powder transport device which transports cement; (5) a powder transport device which transports a paint for industry which lowers the viscosity by mixing the paint in an air flow; (6) a powder transport device which transports glass beads for industry used for road paint components, filler materials of air beds, etc.

In addition, when using powder with high hardness such as a 2-component developing agent, a glass bead, etc., if the porous members (air jet members) 33 (flowable floor) are made of a resin material, such as PE or PC, the porous members may be deformed or damaged with time. And the holes of the porous members may be closed by the deformed or damaged resin members. To obviate the problem, it is desirable to form the air jet members with a fine-mesh metal filter or a sintered material of copper or iron.

Moreover, the image forming system of the above-described embodiment may be connected to a LAN, and the amount of the remaining toner in the powder storing unit 31 or the state of the image forming device may be monitored via the network. When such a supervisory system is built, the serviceman can check the use condition of the user's image forming system, so that the exchange time of the powder storing unit and the abnormalities of the image forming device can be grasped in advance.

The present invention is not limited to the above-described embodiments, and variations and modifications may be made without departing from the scope of the present invention.

The present application is based on and claims the benefit of priority of Japanese patent application No. 2006-065750, filed on Mar. 10, 2006, and Japanese patent application No. 2006-124698, filed on Apr. 28, 2006, the entire contents of which are hereby incorporated by reference.

What is claimed is:

1. A powder transport device which transports powder to a powder receiving device by mixing the powder to an air flow, the powder transport device including a powder storing unit having a powder storing part which stores powder, and a container unit having a container part in which the powder storing unit is accommodated, the powder storing unit comprising:

a motor part for operating the powder storing unit;

an electrical wiring for transmitting an electric signal sent from the motor part or a driving current sent to the motor part in order to drive the motor part; and a first connector for providing electrical conduction between the electrical wiring and an external wiring, the container unit comprising:

a second connector electrically connected to the external wiring, the second connector being engaged with the first connector so that the first connector provides electrical conduction between the electrical wiring and the external wiring.

2. The powder transport device according to claim 1, wherein the container unit comprises an opening through which the powder storing unit is placed into or taken out of the container part, and a door for opening or closing the opening, and wherein the second connector is provided on the door so that the first connector and the second connector are engaged when the powder storing unit is accommodated in the container part and the opening is closed by the door.

3. The powder transport device according to claim 2, wherein the container unit comprises a lock which locks or unlocks the door, and the lock is interlocked with engagement of the first connector and the second connector and locks the door.

4. The powder transport device according to claim 3, wherein the lock is an electronic lock.

5. The powder transport device according to claim 2, wherein the powder transport device is controlled so that, when the door is opened, the powder stored in the powder storing part is not transported to the powder receiving device.

6. The powder transport device according to claim 2, further comprising a pump which attracts the powder stored in the powder storing part through a suction pipe and discharges the powder to the powder receiving device, wherein the pump is controlled so that operation of the pump is allowed only when the opening is closed by the door and the first connector and the second connector are engaged.

7. The powder transport device according to claim 2, wherein the powder storing unit comprises an air jet member which discharges air from a bottom of the powder storing part to an inside of the powder storing part, and the air jet member is controlled so that operation of the air jet member is allowed irrespective of opening or closing of the door.

8. A powder transport device which transports powder to a powder receiving device by mixing the powder to an air flow, the powder transport device comprising:

a powder storing unit having a powder storing part which stores powder and having a first connector provided therein; and a container unit having a container part in which the powder storing unit is accommodated and having a second connector provided therein, wherein the powder transport device is constituted so that, when accommodation of the powder storing unit in the container part is completed, the first connector and the second connector are electrically connected together and transmission of an electric signal and/or a driving current between the powder storing unit and the container unit is allowed.

9. The powder transport device according to claim 8, wherein the container unit comprises an opening through which the powder storing unit is placed into or taken out of the container part, and a door for opening or closing the opening, and wherein the second connector is provided on the door so that the first connector and the second connector are engaged when the powder storing unit is accommodated in the container part and the opening is closed by the door.

10. The powder transport device according to claim 9, wherein the container unit comprises a lock which is interlocked with the engagement the first connector and the second connector and locks the door.

11. The powder transport device according to claim 10, wherein the lock is an electronic lock.

12. The powder transport device according to claim 9, wherein the powder transport device is controlled so that, when the door is opened, the powder stored in the powder storing part is not transported to the powder receiving device.

13. The powder transport device according to claim 9, further comprising a pump which attracts the powder stored in the powder storing part through a suction pipe and discharges the powder to the powder receiving device, wherein the pump is controlled so that operation of the pump is allowed only when the opening is closed by the door and the first connector and the second connector are engaged.

14. The powder transport device according to claim 9, wherein the powder storing unit comprises an air jet member which discharges air from a bottom of the powder storing part to an inside of the powder storing part, and the air jet member is controlled so that operation of the air jet member is allowed irrespective of opening or closing of the door.

15. The powder transport device according to claim 1, wherein the powder storing unit comprises casters and the container unit comprises a regulation member which regulates a direction of movement of the casters.

16. An image forming system in which an image forming device and a powder transport device are provided, the powder transport device including a powder storing unit having a powder storing part which stores powder, and a container unit having a container part in which the powder storing unit is accommodated, the powder storing unit comprising:

a motor part for operating the powder storing unit;

an electrical wiring for transmitting an electric signal sent from the motor part or a driving current sent to the motor part in order to drive the motor part; and a first connector for providing electrical conduction between the electrical wiring and an external wiring, the container unit comprising:

a second connector electrically connected to the external wiring, the second connector being engaged with the first connector so that the first connector provides electrical conduction between the electrical wiring and the external wiring, wherein the image forming device performs image formation using the powder transported by the powder transport device.

17. The image forming system according to claim 16, wherein the powder transport device is constituted so that the powder transport device is separate from the image forming device.

18. The image forming system according to claim 16, wherein the powder transport device is constituted integrally with the image forming device.

19. The image forming system according to claim 16, wherein the powder is a toner.

20. The image forming system according to claim 16, wherein the powder is a 2-component developing agent including a toner and a carrier.

* * * * *